US006006749A

United States Patent [19]

Semeia

[11] Patent Number: 6,006,749

[45] Date of Patent: Dec. 28, 1999

[54] REGULATING MEMBRANE FOR A BREATHING APPARATUS AND A METHOD OF MAKING SAME

[75] Inventor: Roberto Semeia, San Salvatore Di Cogorno, Italy

[73] Assignee: Scubapro Europe S.r.l., Italy

[21] Appl. No.: 09/083,084

[22] Filed: May 22, 1998

[30] Foreign Application Priority Data

May 28, 1997 [IT] Italy ..... GE97A0049

[51] Int. Cl.[6] ..... A62B 9/02

[52] U.S. Cl. ..... 128/205.24; 128/201.28; 128/204.26

[58] Field of Search ..... 128/201.28, 204.26, 128/205.24

[56] References Cited

U.S. PATENT DOCUMENTS

| | | | |
|---|---|---|---|
| 2,758,596 | 8/1956 | Cupp | 128/204.25 |
| 3,974,851 | 8/1976 | Garretson | 128/204.26 |
| 4,508,118 | 4/1985 | Toth | 128/204.26 |

*Primary Examiner*—Aaron J. Lewis
*Attorney, Agent, or Firm*—Larson & Taylor

[57] ABSTRACT

Method for manufacturing regulating membranes for breathing apparatus characterized in that it comprises a phase of molding of the aforesaid membrane during which a disk, made of rigid or semi-rigid material, is embedded and anchored inside the membrane itself, which presents continuity of material on the upper part.

12 Claims, 3 Drawing Sheets

REGULATING MEMBRANE FOR A BREATHING APPARATUS AND A METHOD OF MAKING SAME

BACKGROUND AND SUMMARY OF THE INVENTION

The present invention relates to a method for manufacturing membranes, in particular regulating membranes for breathing apparatus, and relates also to a regulating device for breathing apparatus comprising a membrane obtained according to the method.

More in particular, the present invention relates to a method for manufacturing membranes used for regulating the supply of air in second stages of breathing apparatus for underwater diving.

It is well-known that such regulators generally comprise a container body, communicating with an air supply pipe, where an air supply valve is located, and a pipe supplying air towards a breathing device. This container is generally delimited at the top by a cover, beneath which is set a membrane of known type, to which are connected means of operation of the above-mentioned air supply valve.

In such regulators of air supply, a plastic or metal disk is generally inserted in the membrane; this disk is previously painted and, during moulding of the membrane, the paint is polymerized to guarantee adherence. This disk associates the movement of the membrane with the opening and closing of the aforementioned air-supply regulating valve.

In such cases, if the paint has not been properly applied, traces of grease may cause detachment of the disk with prolonged use of the breathing apparatus, so that the air supply is blocked.

Furthermore, a regulator of air supply is known, comprising a double-flanged disk which, after the phase of moulding of the membrane, is inserted into a hole at the centre of the membrane.

The purpose of the present invention is to overcome the problems referred to above.

More in particular, the purpose of the present invention is to create a method for manufacturing regulating membranes for breathing apparatus that are able to guarantee perfect water-tightness of the membrane with the disk referred to connected to any regulating device of known type associated to the air supply device.

A further purpose of the present invention is to propose a method for manufacturing regulating membranes for breathing apparatus in which the disk referred to is made of any rigid or semi-rigid material.

These and other purposes specified in what follows are achieved by the present invention regarding a method for the manufacture of regulating membranes for breathing apparatus, comprising a phase of moulding of the said membrane, during which a disk made of rigid or semi-rigid material is embedded and anchored inside the membrane itself, which presents continuity of material on its upper side.

BRIEF DESCRIPTION OF THE DRAWINGS

These and further characteristics of the method for manufacturing regulating membranes for breathing apparatus, which is the subject of the present invention, will appear more clearly from the detailed description of the invention, carried out with reference to the figures of the attached drawings, which schematically represent some preferred embodiments of membranes made using the method according to the present invention and applied to a generic second supply stage for breathing apparatus.

In the drawings.

DESCRIPTION OF THE PREFERRED EMBODIMENT OF THE INVENTION

Figure 1:
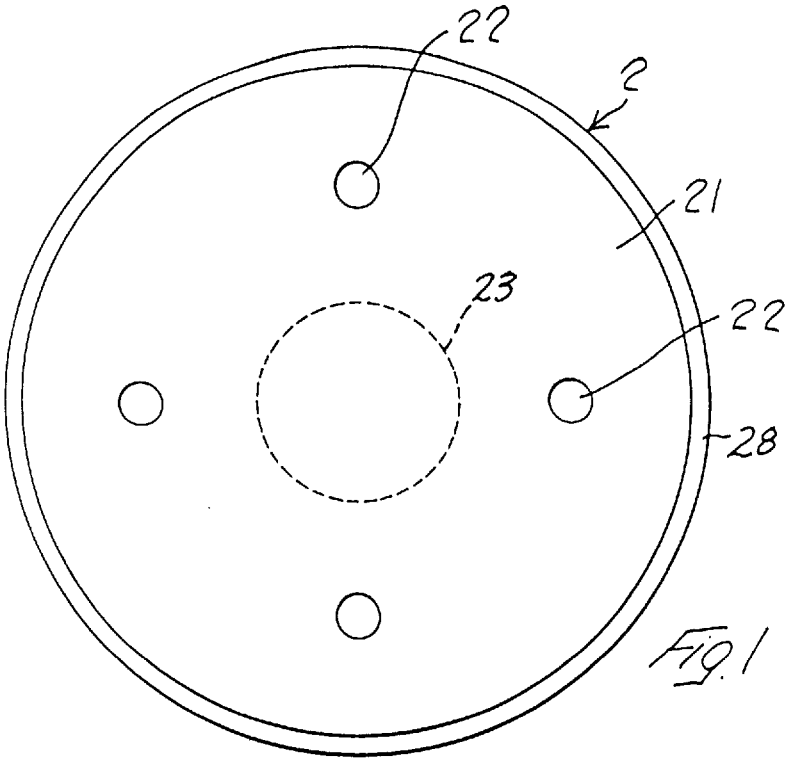
FIG. 1 represents schematically a top view of the disk connecting to the membrane according to one embodiment of the present invention.
Figure 2:
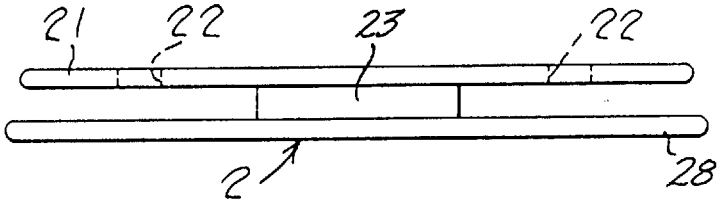
FIG. 2 represents schematically a side view of the same disk as the one shown in FIG. 1.
Figure 3:
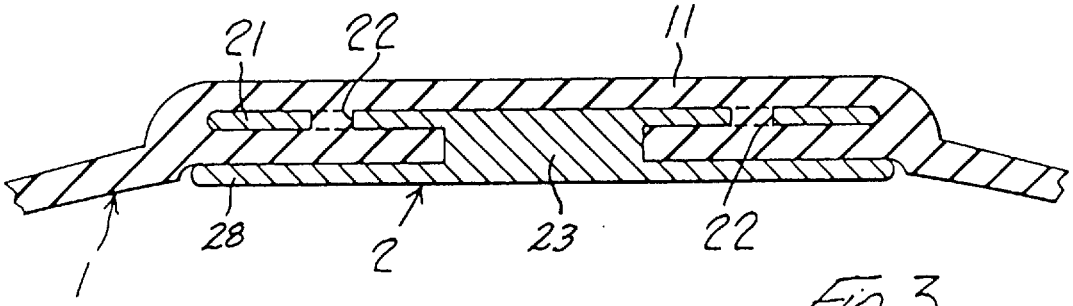
FIG. 3 represents schematically a cross-sectional view of the membrane and the disk of FIG. 1 joined together following on application of the method which is the subject of the present invention.

With reference to FIGS. 1, 2 and 3, the membrane 1 and the disk 2 are represented; i.e., the elements that are fundamental for the application of the method.

The disk 2 has a central portion 23 and two flanges, an upper one 21, provided with a number of holes 22, and a lower one 28, which is smooth. The two flanges have basically the same diameter. The holes 22 are arranged in a path located radially outwardly from the central portion.

According to the method of the present invention, during the phase of moulding of the membrane 1, the disk 2 is embedded in the material of the membrane that is inserted to fill the space between the two flanges 21 and 28 of the disk 2 and penetrates inside the holes 22 of the upper flange.

In particular, FIG. 3 represents the membrane 1 and disk 2 assembly after the moulding phase, in which the disk is inserted in the membrane 1, the upper surface 11 of which is covered by the material of the membrane to present continuity of material, and hence perfect water-tightness.

Figure 4:
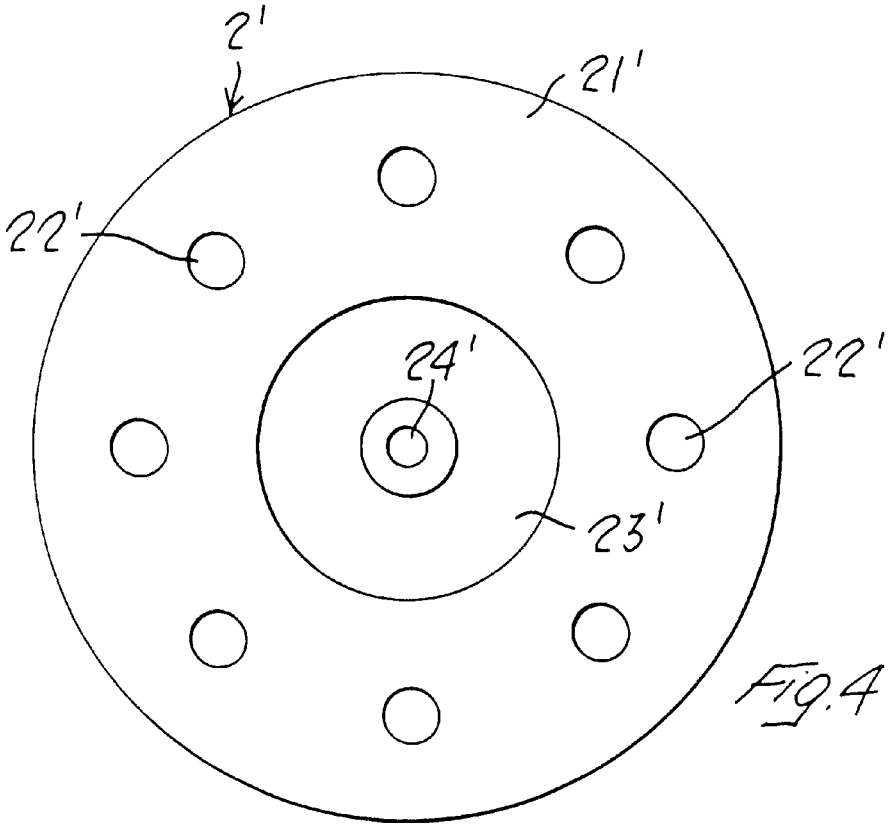
FIG. 4 represents schematically a top view of the disk connecting to the membrane according to a second embodiment of the present invention.
Figure 5:
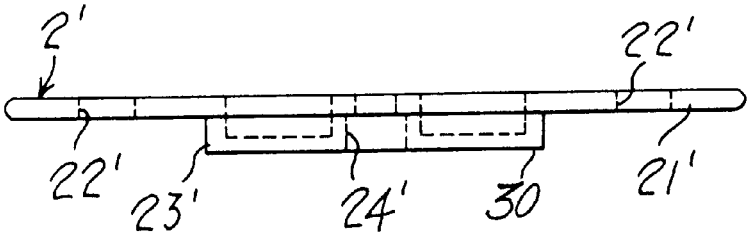
FIG. 5 represents schematically a side view of the same disk as the one shown in FIG. 4.
Figure 6:
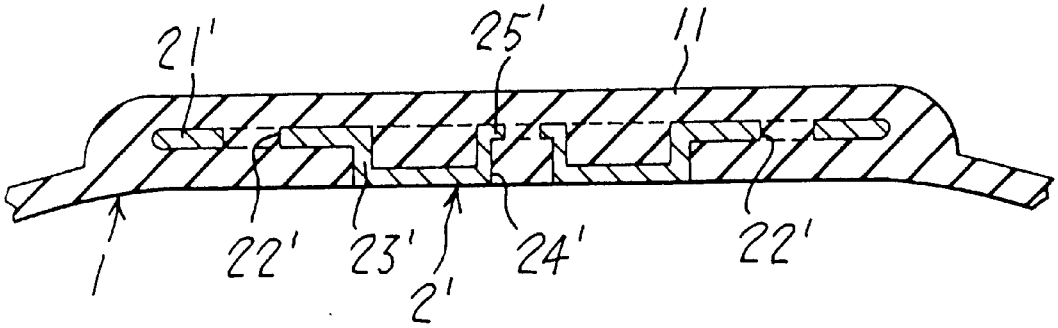
FIG. 6 represents schematically a cross-sectional view of the membrane and disk of FIG. 4 joined together following on application of the method which is the subject of the present invention.

With reference to FIGS. 4, 5 and 6, the membrane 1 and a disk 2' are shown according to an alternative embodiment of the present invention.

In fact, the disk 2' presents an upper flange 21' provided with a number of holes 22' and a central portion 23', which is smooth and inset with respect to the flange to form a central step 30 and is provided on its lower surface with a central through hole 24'. This hole 24' presents a circular border 25' at its upper end.

According to the method of the present invention, during the phase of moulding of the membrane 1, the disk 2' is embedded in the material of the membrane that penetrates inside the holes 22' of the flange 21', inside the central area 23', and inside the hole 24', thus creating a secure mechanical fastening. The holes 22' are arranged in a path located radially outwardly from the central portion.

In particular, FIG. 6 illustrates the membrane and disk assembly after the moulding phase, in which the disk 2' is inserted in the membrane 1, the upper surface 11 of which is covered by the material of the membrane to present continuity of material, and hence perfect water-tightness. On the lower side, the lower face of the membrane is coplanar with the lower surface of the central portion.

Figure 7:
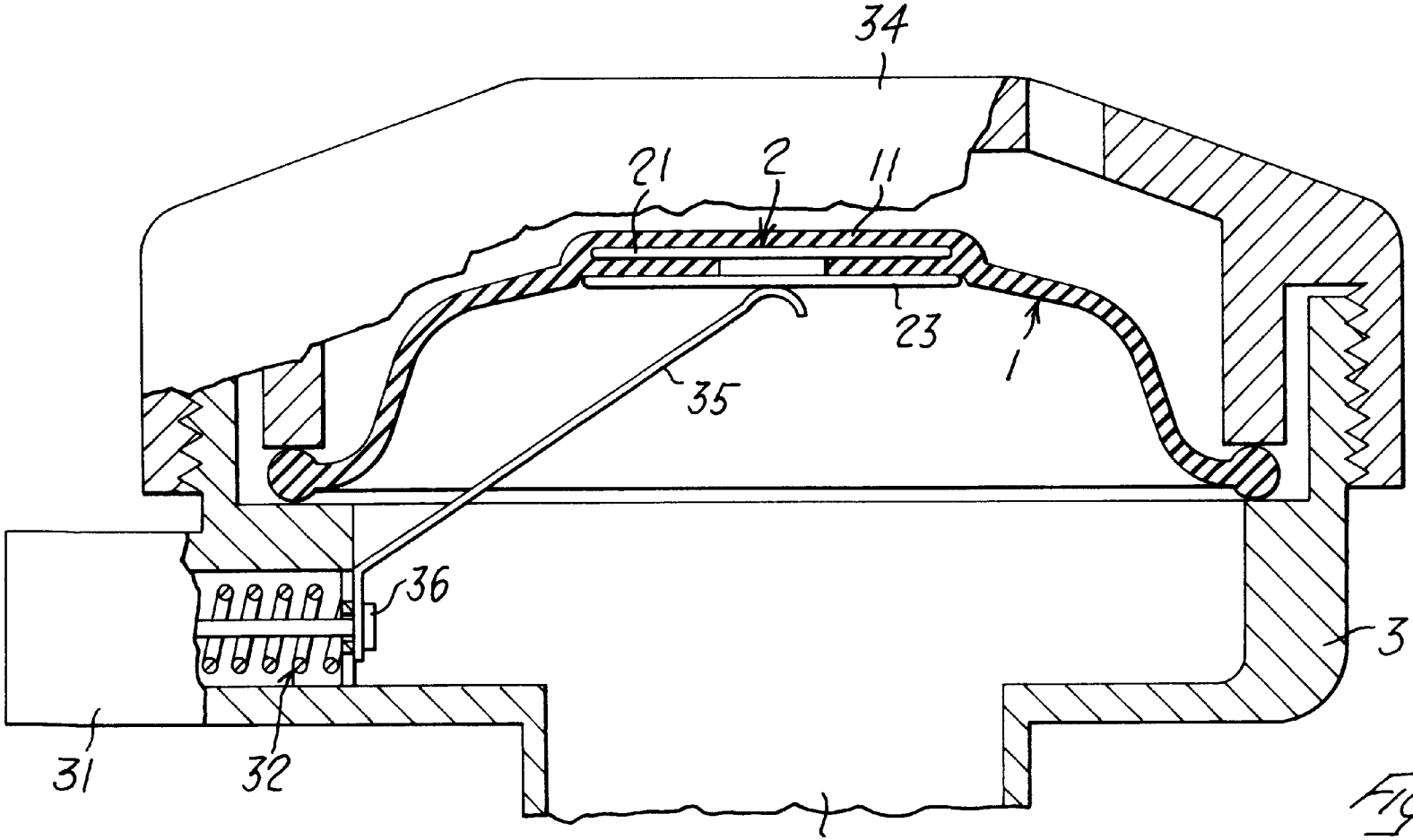
FIG. 7 represents schematically a partial sectional view of a regulating device for breathing apparatus to which is applied a membrane made according to the method which is the subject of the present invention.

FIG. 7 shows the membrane 1, obtained by applying the method according to the present invention, applied, to provide an example, to a regulating device for breathing apparatus of a known type. This regulating device comprises a container body 3 communicating with an air intake pipe 31, where an air supply valve 32 is located, and a pipe 33 supplying air to a breathing device. This container is generally delimited above by a cover 34, beneath which is set a membrane 1 of known type, to which are connected means of operation of the above-mentioned air supply valve 32.

Such means of valve operation are exemplified by an actuating lever 35 connected to the lower flange 23 of the disk 2 and with the actuating rod 36 that operates the valve 32.

From the foregoing description of the method for manufacturing regulating membranes for breathing apparatus that is the subject of the present invention, the advantages already referred to emerge more clearly.

In fact, in both embodiments the connection between the disk and the membrane is of a mechanical type; hence, there is no possibility of any accidental detachment occurring between the two parts. Furthermore, the upper part of the membrane is continuous and smooth, and so is able to guarantee perfect water-tightness of the membrane itself with the disk referred to connected to the membrane.

Finally, the disk referred to herein may be made of any rigid or semi-rigid material, given that no paints or glues are required to join the membrane and disk together.

What I claim is:

1. A regulating membrane for a breathing apparatus, comprising:

a disk made of rigid or semi-rigid material and having a flange with a plurality of holes therethrough, which holes are arranged in a path about the center of the disk, a central portion of the disk located radially inside of the flange, which central portion projects outwardly only to a first side of the disk, such that said first side has a central step which is raised up relative to the flange, and a second side of the disk which lies generally within a plane, a membrane formed integrally with the disk, wherein the disk is embedded within and thus anchored to the material of the membrane during the moulding process, the membrane extending completely over the second side of the disk, and said membrane extending over the flange on the first side of the disk up to the central step, such that the face of the membrane on the first side of the disk is co-planar with the outermost surface of the said central portion, and the material of the membrane filling said holes, connecting the portions of the membrane on both sides of the disk in the area of the flange.

2. A regulating membrane according to claim 1, wherein the disk has a central through hole, and the material of the membrane fills the central through hole.

3. A regulating membrane according to claim 1, wherein the second side of the disk is a continuous planar surface except for said through holes.

4. A regulating membrane according to claim 1, wherein the second side of the disk includes at least one recess extending into the inside of the central portion, which recess is filled with the material of the membrane.

5. A regulating membrane for a breathing apparatus comprising a disk made of rigid or semi-rigid material and having a central portion and two flanges extending outwardly therefrom on each side of the disk, a flange on a first side of the disk having a plurality of holes arranged in a path radially outwardly from the central portion, a membrane formed integrally with the disk, wherein the disk is embedded with and thus anchored to the membrane during the moulding process, said membrane extending completely over said first side of said disk, completely covering same and said membrane extending into and filling the space between the flanges, such that the material of the membrane covering the first side of the disk and the material of the membrane between the flanges are connected and anchored to each other by the material which fills the said through holes.

6. A regulating membrane according to claim 5, wherein the first and opposite sides of the disk are continuous except for the said holes through one of the flanges.

7. A regulating device for a breathing apparatus comprising a container body communicating with an air intake pipe, an air supply valve located in the container body, and a pipe communicating with the container body and supplying air to a breathing device, a cover for said container, said cover comprising a regulating membrane containing a disk which is operatively connected to a means for operating said air supply valve, the disk of said regulating membrane made of a rigid or semi-rigid material and having a flange with a plurality of holes arranged in a path about the center of the disk, a central portion of the disk located radially inside of the flange, which central portion projects outwardly only to a first side of the disk, such that said first side has a central step which is raised up relative to the flange, and a second side of the disk which lies generally within a plane, a membrane formed integrally with the disk, wherein the disk is embedded within and thus anchored to the material of the membrane during the moulding process, the membrane extending completely over the second side of the disk, and said membrane extending over the flange on the first side of the disk up to the central step, such that the face of the membrane on the first side of the disk is co-planar with the outermost surface of the said central portion, and the material of the membrane filling said holes, connecting the portions of the membrane on both sides of the disk in the area of the flange.

8. A regulating device according to claim 7, wherein the disk has a central through hole, and the material of the membrane fills the central through hole.

9. A regulating device according to claim 7, wherein the second side of the disk is a continuous planar surface except for said through holes.

10. A regulating device according to claim 7, wherein the second side of the disk includes at least one recess extending into the inside of the central portion, which recess is filled with the material of the membrane.

11. A method of manufacturing a regulating membrane for a breathing apparatus comprising taking a disk made of a rigid or semi-rigid material and having a flange with a plurality of through holes arranged in a path around the center of the disk, wherein a central portion of the disk is located radially inside of the flange to provide a central portion which projects out on a first side of the disk, and moulding a membrane integrally with the disk wherein the disk is embedded in the material of the membrane and anchored to the membrane during the molding process, wherein the material of the membrane extends completely over a second side of the disk, fills the through holes and extends over the first side of the disk up to the central portion such that the face of the membrane is co-planar with the outer surface of the central portion.

12. The method of claim 11, wherein the disk has a central through hole and the moulding step includes filling the central through hole with the material of the membrane.

* * * * *